US007237292B1

(12) United States Patent
Endres

(10) Patent No.: US 7,237,292 B1
(45) Date of Patent: Jul. 3, 2007

(54) BELT FASTENED BOTTLE OPENER

(76) Inventor: Terry Endres, P.O. Box 22, Fort Collins, CO (US) 80522-0022

( * ) Notice: Subject to any disclaimer, the term of this patent is extended or adjusted under 35 U.S.C. 154(b) by 0 days.

(21) Appl. No.: 11/327,254

(22) Filed: Jan. 5, 2006

Related U.S. Application Data

(60) Provisional application No. 60/642,770, filed on Jan. 10, 2005.

(51) Int. Cl.
*B67B 7/16* (2006.01)
*B25B 33/00* (2006.01)

(52) U.S. Cl. ..... 7/151; 81/3.07

(58) Field of Classification Search ..... 7/151; 81/3.07, 3.25
See application file for complete search history.

(56) References Cited

U.S. PATENT DOCUMENTS 1,267,052 A * 5/1918 Burnett ..... 7/151
D158,957 S * 6/1950 Haberkorn et al. ..... D8/18
3,693,482 A * 9/1972 Herold ..... 81/3.07
4,923,392 A * 5/1990 Moynihan, III ..... 431/253
5,531,365 A * 7/1996 Donnelly ..... 224/576
D409,464 S * 5/1999 Garza ..... D8/34
6,185,772 B1 * 2/2001 Bates ..... 7/151
6,212,721 B1 * 4/2001 Borodulin et al. ..... 7/156
6,836,920 B1 * 1/2005 Scannell ..... 15/104.94
6,851,147 B2 * 2/2005 Abrahall ..... 7/151

* cited by examiner

*Primary Examiner*—David B. Thomas
(74) *Attorney, Agent, or Firm*—James K. Poole, Esq.

(57) ABSTRACT

A one-piece wearable bottle opener that slips onto a persons belt, without the aid of special attachments. The preferred location to wear the opener is at either hip. The opener functions easily, using one hand, because of three features. The top section is prevented from moving outward, due to the tightened belt, the opener detail is located below the belt, creating leverage, and the lower plate section prevents the opener from moving inward, as it is pressed against the bony hip area, allowing the opener to function. The space above the opener detail, and between the belt attachment details, is used for advertising of related products, festivals, artwork and such.

19 Claims, 2 Drawing Sheets

BELT FASTENED BOTTLE OPENER

CROSS REFERENCE TO RELATED APPLICATION

This application relates to the subject matter of provisional patent application 60/642,770 filed Jan. 10, 2005, from which priority is claimed. This application is also incorporated herein by reference.

BACKGROUND OF THE INVENTION

Field of the Invention

This invention relates to the field of bottle openers and particularly to the field of wearable bottle openers that function as usable openers, as well as advertising tools.

Bottle openers were developed to open a variety of bottles, including those with caps that are crimped to seal in the contents, whether it be beer, soda, or other liquids. Openers are available in many different designs, including hand held, wall mounted, vending machine mounted, as well as other styles. In the past few decades, twist off bottle caps have become popular, but are not without hazards. Professional bartenders prefer to use bottle openers, as twisting off too many bottle caps, with bare hands, can hurt or cut a person's hand. Traditional bottle openers remain popular, as they function well, but lack advertising appeal, as they are usually hidden from view.

Advertising on shirts, jackets, caps, shoes, watches and other wearable apparel is a popular practice for advertisers, as it gets their name seen.

Hundreds of different types and styles of bottle openers exist, including a few bottle openers that are incorporated into belt buckles, including U.S. Pat. Nos. 6,185,772 and 4,135,267. These belt buckle bottle openers are generally difficult to use, as they twist, or rotate the belt, with the opener detail being positioned at belt level, thus the belt buckle needs to be removed for the opener to function.

SUMMARY OF THE INVENTION

A bottle opener is provided that attaches to a common belt, typically worn around a person's waist. The opener attaches to a belt without the aid of special clips, nails, screws, snaps, rivets, sewing and such. It slips off the belt as easily as it slips on, leaving the belt with its original appearance. Though the opener can be placed on any area of the belt, the preferred location is at either hip, making it easy to use with the left or right hand. The belt fastened bottle opener is not a belt buckle, as it is preferably slipped onto the belt, at the hip. Utilizing leveraged design, the bottles easily open with one hand, as the opener detail is located below belt level. The belt fastened opener does not twist or rotate in use, as the top section 8, is fixed in place with a tightened belt. The lower section 10, is prevented from rotating, as it is forced against the rigid area of the wearers hip, below the belt, as the bottle is forced downward for opening. The opener allows bartenders or waiters to conveniently open a bottle with one hand while holding a tray or other item with the other hand, thus making their work easier.

The opener could be manufactured with many different materials or processes. Since it is beneficial to be strong and lightweight, certain cast metal alloys work well, providing a durable and attractive product, that can be customized for different artwork or advertising. This is a single piece opener and advertising product that slips on and off any belt, without special attachments.

The belt fastened bottle opener is a one-piece product, with three different areas for different functions. The top section 8 provides attachment to the belt, while creating advertising or artwork space. The center section 9 is designed to remove bottle caps, when a bottle is placed into the opening detail 6, and pushed down. The lower section 10, with its curved backside 7, is pressed against the wearer's hip, or other body area, as the bottle is pressed down, removing the bottle cap.

DETAILED DESCRIPTION OF PREFERRED EMBODIMENTS

A preferred embodiment of the present invention is illustrated in FIGS. 1-4. The disclosure of the descriptive embodiments are for explanatory purposes only and are not meant to limit the scope of the invention. It is to be expressly understood that the disclosed preferred embodiments are not meant to limit the scope of the invention. Other embodiments using not only existing technology, but technology developed later are also considered to be within the scope of the invention.

While the opener could be made of many different materials, the preferred embodiment is a metal alloy, being strong and lightweight. The opener could be manufactured with a number of different processes, but the preferred process is metal casting. The opener can be made in casting processes, using pressure between 0-5,000 tons. The opener can be cast with a metal alloy having a Brinell hardness rating between 50-300 and a shear strength rating between 20-200 ksi. The opener, with its compound shape, can be cast with variations in wall thickness. The opener can be molded in other materials, including plastic. The opener can also be manufactured by other processes, including metal stamping. The opener can be finished with different processes, including polishing, tumbling, texturing, painting, anodizing and such, thereby creating different looks.

Figure 1:
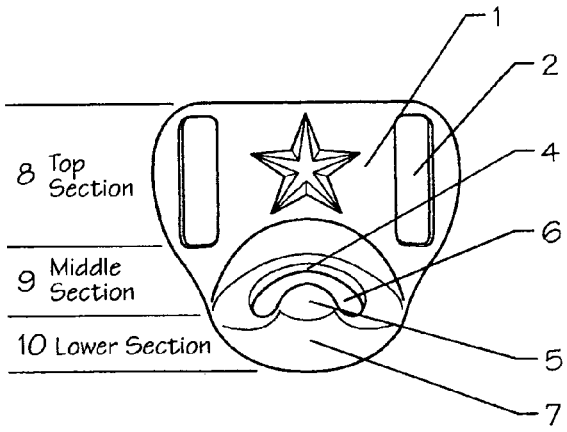
FIG. 1: Front View, showing top, middle and lower sections, as well as details.
Figure 2:
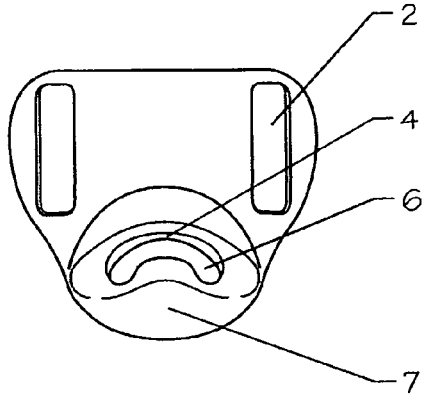
FIG. 2: Back View, showing a few details.
Figure 3:
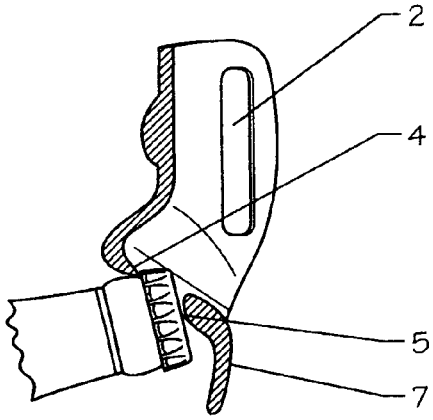
FIG. 3: Vertical Cross-Section View through the center, showing a few details, including bottle cap.
Figure 4:
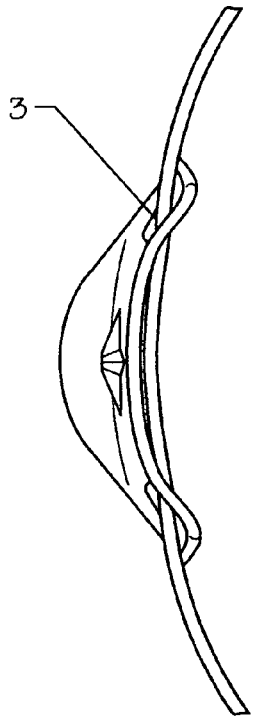
FIG. 4: Top View, showing belt attachment.
Figure 5:
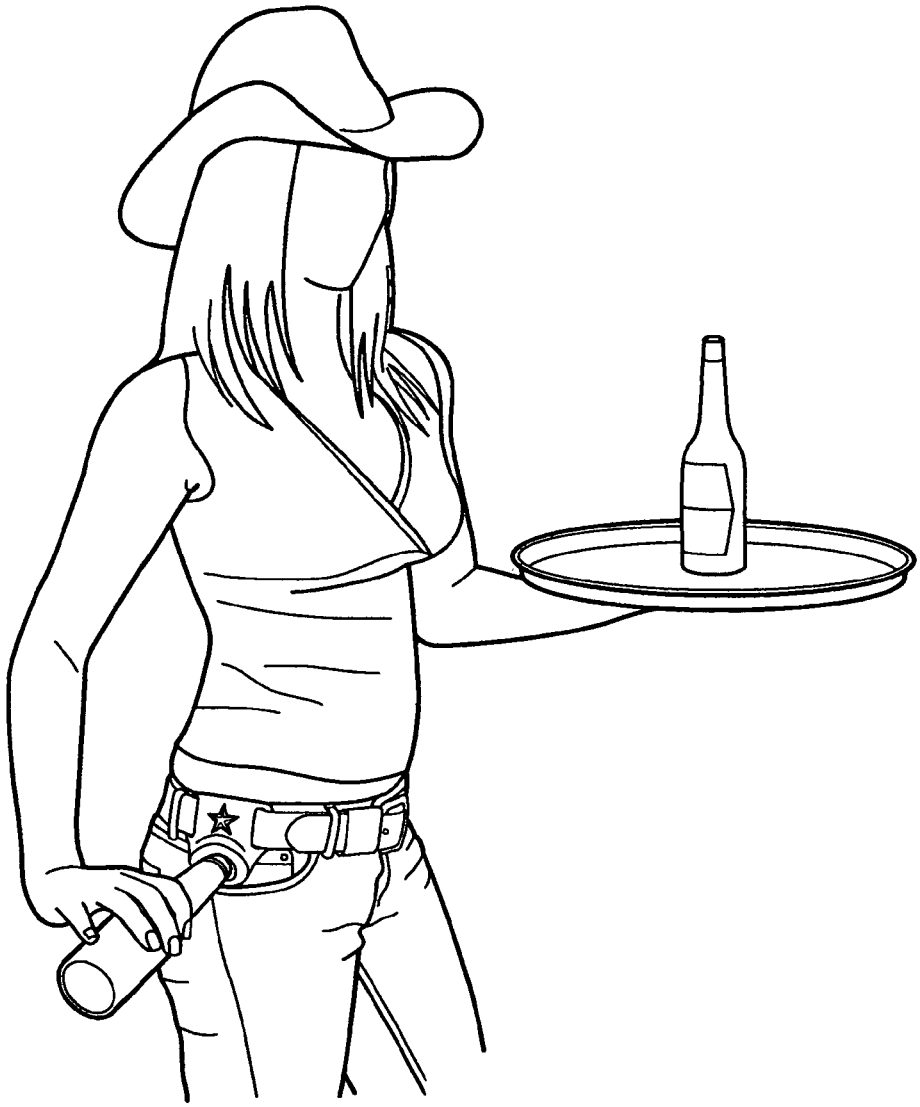
FIG. 5: Shows a professional server using the wearable belt-mounted opener.

A belt-fastened bottle opener is illustrated in FIG. 1, utilizing a preferred embodiment of the present invention. In the one-piece preferred embodiment, the opener has three different sections, providing different functions.

The top section 8 provides for easy attachment to a person's belt, while the space between the belt openings 2, is suitable for advertising or artwork. Placing the advertising and artwork space above the opener detail, between the belt attachment details, is the optimal area for such graphics, whereby allowing wearable opener to serve as a great advertising tool. In addition the advertising or artwork is even visible as the opener is being used. Such advertising or artwork can be cast into the opener, or applied using techniques such as pad printing or dye sublimation heat transfers, thus making the advertising available in color.

Different belt attachment designs are possible, but the simple slot openings 2, illustrated here, work well, making it easy to fasten to the belt and easy to remove, without changing the appearance of the belt. The opener can be attached at any area of the belt, but the preferred location is at either hip, for convenient use with either hand, as the opener is pressed against the rigid bony area of the hip during the opening process.

The middle section 9 of the opener includes the bottle opener details, typical of prying type openers. Locating the opener detail that removes the bottle cap below the belt, rather than at belt level, prevents the belt from twisting or rotating, further enabling the opener to function properly, with one hand. The details include:

A lip 4, which catches one section of the bottle cap, prying it off as the bottle is forced downward.

A nub 5, which presses against the center of the bottle cap as the bottle is forced downward for opening. The nub crimps the bottle cap as the cap is forced against it, aiding in the cap removal.

An open space 6 between the lip and nub, allowing the bottle cap to latch onto the backside of the lip 4.

The lower section 7 of the opener is simply a plate area, rounded on the backside for comfort as it is forced against the wearer's body. The lower section plate area, with its convex backside, also aids the wearable opener to function properly, as it is forced against the wearer's body during the opening process. With the top section 8 being firmly attached to the tightened belt, the lower section 7 is also prevented from moving, as the backside of the rounded plate area 7 is pressed against the wearer's hip area.

It is the design of the belt fastened bottle opener, with the opening details located below the belt, preventing the belt from twisting or rotating, that enables the opener to function easily, using one hand. Using the preferred embodiments described creates a wearable product that functions well and fastens to a belt without special attachments, while serving as a great advertising tool for breweries or other companies.

The fact that bartenders prefer specialty openers to ease their work is verified by the variety of openers on the market, designed for professionals. They include ring openers, wrist fastened openers, openers on cord reels, and others, all requiring the use of both hands. As mentioned, belt buckle openers also exist, but they don't work well, as they twist the belt instead of opening the bottle. They require special attachments to attach the buckle, in a precarious spot above the groin area. The belt fastened bottle opener works as well as a wall-mounted opener, and is always at your side. The opener further improves working conditions of professional bartenders, as an opener is always at their side. The wearable opener, with its advertising potential, especially appeals to related industries, such as breweries, which are already advertising on T-shirts, caps, mugs and such. The opener, with its advertising appeal, not only applies to advertising products such as beer, but to events and festivals, wherein making it an attractive and durable commemorative product, similar but more durable than T-shirts or caps. The fun-function-fashion combination of this wearable bottle opener makes it attractive to users and advertisers. This advertising potential would also appeal to organizations licensing from pro sports teams, college sports teams, NASCAR and such, thus making the opener a fashion accessory comparable to T-shirts or caps. Openers with such wearable advertising appeal can be further enhanced with a wall mounting bracket (not shown here) especially designed for the opener, allowing it to be used either as a traditional wall-mounted opener or bottle opener wearable.

DESCRIPTION OF DETAILS

1. Advertising area, between the belt attachment details.
2. Belt attachment details.
3. Slight crimp in the belt, as it passes thru the attachment openings.
4. Lip, that pries off the bottle cap.
5. Nub, that presses against the bottle cap.
6. Opening, that the bottle cap fits into.
7. Plate area, convex shape on the backside.
8. Top Section; Advertising/Artwork area and belt attachment openings.
9. Middle Section; Including cap removal details.
10. Lower Section; Plate area, that is forced against the hip.

I claim:

1. A wearable bottle opener having a middle section comprising a lip and a nub spaced beneath said lip to accommodate a capped beverage bottle for opening, a lower section comprising a plate area adapted to rest against the wearer's hip and an upper section comprising attachment means for fastening said opener to the belt of a wearer, with said middle section facing outward, wherein the pressure exerted by the opening of said bottle causes said opener to remain in position due to pressures exerted upon said belt and said user's hip.

2. The opener of claim 1 which is manufactured of a strong, lightweight casting alloy which is durable and corrosion resistant.

3. The opener of claim 2 which is finished by processes selected from the group consisting of polishing, tumbling, texturing, painting and anodizing, thereby creating different appearances.

4. The opener of claim 1 which is designed in shapes utilizing rounded edges, making it comfortable to wear.

5. The opener of claim 1, further comprising belt attachment means making it easy to fasten to said belt, and easy to remove, without changing the appearance of the belt.

6. The opener of claim 5 wherein said belt attachment means comprise slot openings on either side of said upper section.

7. The opener of claim 6 wherein said slot openings are vertical and located adjacent a curved section of said upper section, thereby slightly crimping said belt and tending to keep said opener in position on said belt.

8. The opener of claim 1 which is molded from materials comprising plastic.

9. The opener of claim 1 wherein said lower section plate area is formed with a convex backside which aids the wearable opener to function comfortably and properly, as it is forced against the wearer's body during the opening process.

10. The opener of claim 9, which allows the wearer to conveniently open a bottle with one hand.

11. The opener of claim 10 which has a concave opening surrounding said lip and said nub, tending to guide said capped bottle into position and center itself against said nub for opening by said wearer when the top of said bottle is pressed against the middle section of said opener.

12. The opener of claim 1, comprising advertising and artwork space above said opener detail between the belt attachment means.

13. The opener of claim 12, comprising advertising or artwork cast into the opener.

14. The opener of claim 12, comprising advertising or artwork applied to said upper section by techniques selected from the group consisting of pad printing and dry sublimation heat transfers.

15. The opener of claim 1 wherein said lip pries the cap from said bottle and said nub presses against said cap during the opening process.

16. A wearable bottle opener having an outward-facing middle section comprising a concave opening containing a lip and a nub spaced beneath said lip so as to accommodate a capped beverage bottle for opening, a lower section comprising a plate area with a convex curved portion adapted to rest comfortably against the wearer's hip and an upper section comprising vertical slot portions on each side thereof adapted for the wearer's belt to pass through, both sides of said upper section being curved so as to slightly crimp said belt when worn and restrict motion of said opener along said belt, wherein the pressure exerted by the opening of said bottle causes said opener to remain in position due to pressures exerted upon said belt and said wearer's hip.

17. The opener of claim 16 wherein said concave opening in said middle section is configured to guide the top of said bottle into position for opening when the top of said bottle is pressed against said middle section of said opener.

18. The opener of claim 17 wherein the placement of said concave opening, lip and nub within said middle section between said slot openings of said upper section and a concave portion of said plate area of said lower section enable said wearer to easily open said bottle with one hand.

19. The opener of claim 16 which is cast of a lightweight metal or allow thereof, having images comprising at least one of artwork or advertising cast into the upper section thereof.

* * * * *